US005975471A

United States Patent [19]

Dishman

[11] Patent Number: 5,975,471

[45] Date of Patent: Nov. 2, 1999

[54] ROOF BRACKETS FOR MOUNTING AN AUXILIARY ROOF

[76] Inventor: Terry Dishman, 472 Manning Rd., Mogadore, Ohio 44260

[21] Appl. No.: 09/010,757

[22] Filed: Jan. 22, 1998

[51] Int. Cl.[6] ..... H01J 3/14

[52] U.S. Cl. ..... 248/237; 248/238; 182/45

[58] Field of Search ..... 248/237, 238, 248/48.1, 148, 235, 536, 351, 357; 182/45; 52/73, 74, 27

[56] References Cited

U.S. PATENT DOCUMENTS

| | | | |
|---|---|---|---|
| 4,634,144 | 1/1987 | Ringe | 280/763.1 |
| 5,141,076 | 8/1992 | Joyce et al. | 182/108 |
| 5,351,981 | 10/1994 | Thomas | 280/301 |
| 5,615,752 | 4/1997 | Wassil | 182/200 |
| 5,788,204 | 8/1998 | Goodwin et al. | 248/357 |
| 5,791,438 | 8/1998 | Kempton | 182/200 |

*Primary Examiner*—Leslie A. Braun
*Assistant Examiner*—Gwendolyn Baxter

[57] ABSTRACT

A roof bracket system is provided including at least one roofing bracket comprising a base plate positioned on a main roof and having a bottom surface, a top surface and a periphery formed therebetween. The top surface of the base plate of each roofing bracket further has a pair of spaced and parallel wings for containing a joist of an auxiliary roof therebetween.

6 Claims, 3 Drawing Sheets

ROOF BRACKETS FOR MOUNTING AN AUXILIARY ROOF

BACKGROUND OF THE INVENTION

1. Field of the Invention

The present invention relates to brackets and more particularly pertains to a new roof bracket for mounting an auxiliary roof to a house without removing a portion of a roof of the house.

2. Description of the Prior Art

The use of brackets is known in the prior art. More specifically, brackets heretofore devised and utilized are known to consist basically of familiar, expected and obvious structural configurations, notwithstanding the myriad of designs encompassed by the crowded prior art which have been developed for the fulfillment of countless objectives and requirements.

Known prior art brackets include U.S. Pat. No. Des. 303,018; U.S. Pat. No. 4,826,122; U.S. Pat. No. 4,884,775; U.S. Pat. No. 5,113,971; U.S. Pat. No. Des. 319,695; and U.S. Pat. No. 4,880,200.

In these respects, the roof bracket according to the present invention substantially departs from the conventional concepts and designs of the prior art, and in so doing provides an apparatus primarily developed for the purpose of mounting an auxiliary roof to a house without removing a portion of the roof.

SUMMARY OF THE INVENTION

In view of the foregoing disadvantages inherent in the known types of brackets now present in the prior art, the present invention provides a new roof bracket construction wherein the same can be utilized for mounting an auxiliary roof to a house without removing a portion of the roof.

The general purpose of the present invention, which will be described subsequently in greater detail, is to provide a new roof bracket apparatus and method which has many of the advantages of the brackets mentioned heretofore and many novel features that result in a new roof bracket which is not anticipated, rendered obvious, suggested, or even implied by any of the prior art brackets, either alone or in any combination thereof.

To attain this, the present invention generally comprises a generally planar main roof situated upon a building at a first predetermined angle. Also included is a generally planar auxiliary roof having a plurality of joists extending therefrom in coplanar relationship therewith. A plurality of stanchions is coupled to a bottom of the auxiliary roof and extending downwardly therefrom. As best shown in FIGS. 1 & 2, a plurality of roofing brackets each comprises a planar generally rectangular base plate positioned on the main roof. Each base plate has a bottom surface, a top surface and a periphery formed therebetween. The top surface of the base plate of each roofing bracket further has a pair of spaced and parallel wings each defined by a planar member integrally coupled to the base plate and residing in a vertical plane. Each planar member of the wings includes a rear vertical edge, a front beveled edge and an arcuate top edge. Note FIG. 2. Each roof bracket further includes a support module mounted to the base plate and further coupled to the wings therebetween. Each support module includes a rear planar extent residing in a plane which forms an acute angle with the base plate and extends upwardly and forwardly. The support modules each also have a front arcuate extent terminating at the front edge of the parallel wings of the associated roofing bracket. It should be noted that the support module of each roofing bracket has a height less than ⅓ that of the wings. As such, the joists rest upon the support modules between the wings of an associated one of the roofing brackets such that the auxiliary roof resides at a second predetermined angle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roof bracket apparatus and method which has many of the advantages of the brackets mentioned heretofore and many novel features that result in a new roof bracket which is not anticipated, rendered obvious, suggested, or even implied by any of the prior art brackets, either alone or in any combination thereof.

It is another object of the present invention to provide a new roof bracket which may be easily and efficiently manufactured and marketed.

It is a further object of the present invention to provide a new roof bracket which is of a durable and reliable construction.

An even further object of the present invention is to provide a new roof bracket which is susceptible of a low cost of manufacture with regard to both materials and labor, and which accordingly is then susceptible of low prices of sale to the consuming public, thereby making such roof bracket economically available to the buying public.

Still yet another object of the present invention is to provide a new roof bracket which provides in the apparatuses and methods of the prior art some of the advantages thereof, while simultaneously overcoming some of the disadvantages normally associated therewith.

Still another object of the present invention is to provide a new roof bracket for mounting an auxiliary roof to a house without removing a portion of the roof.

Even still another object of the present invention is to provide a new roof bracket that includes at least one roofing bracket comprising a base plate positioned on a main roof and having a bottom surface, a top surface and a periphery formed therebetween. The top surface of the base plate of each roofing bracket further has a pair of spaced and parallel wings for containing a joist of an auxiliary roof therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
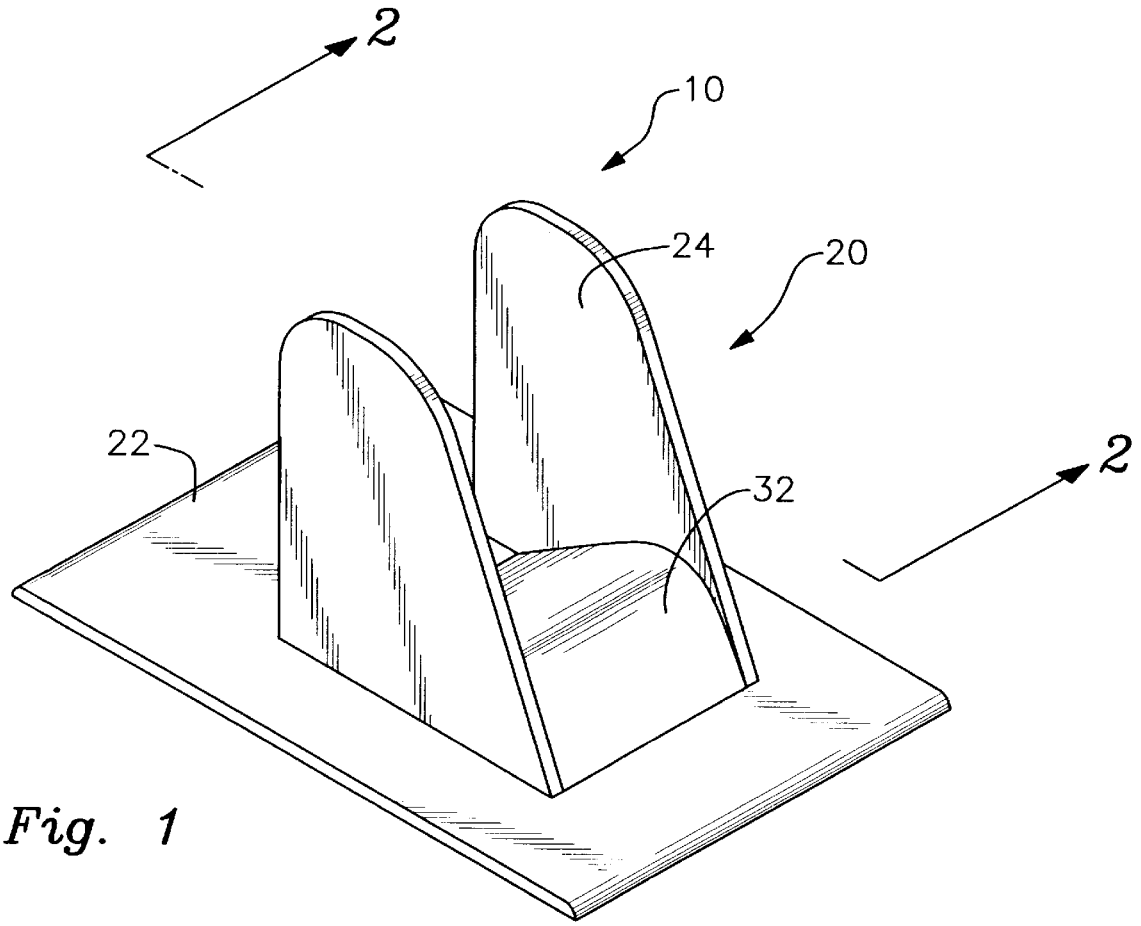
FIG. 1 is a perspective view of a new roof bracket according to the present invention.

With reference now to the drawings, and in particular to FIGS. 1 through 7 thereof, a new roof bracket embodying the principles and concepts of the present invention and generally designated by the reference numeral 10 will be described.

Figure 3:
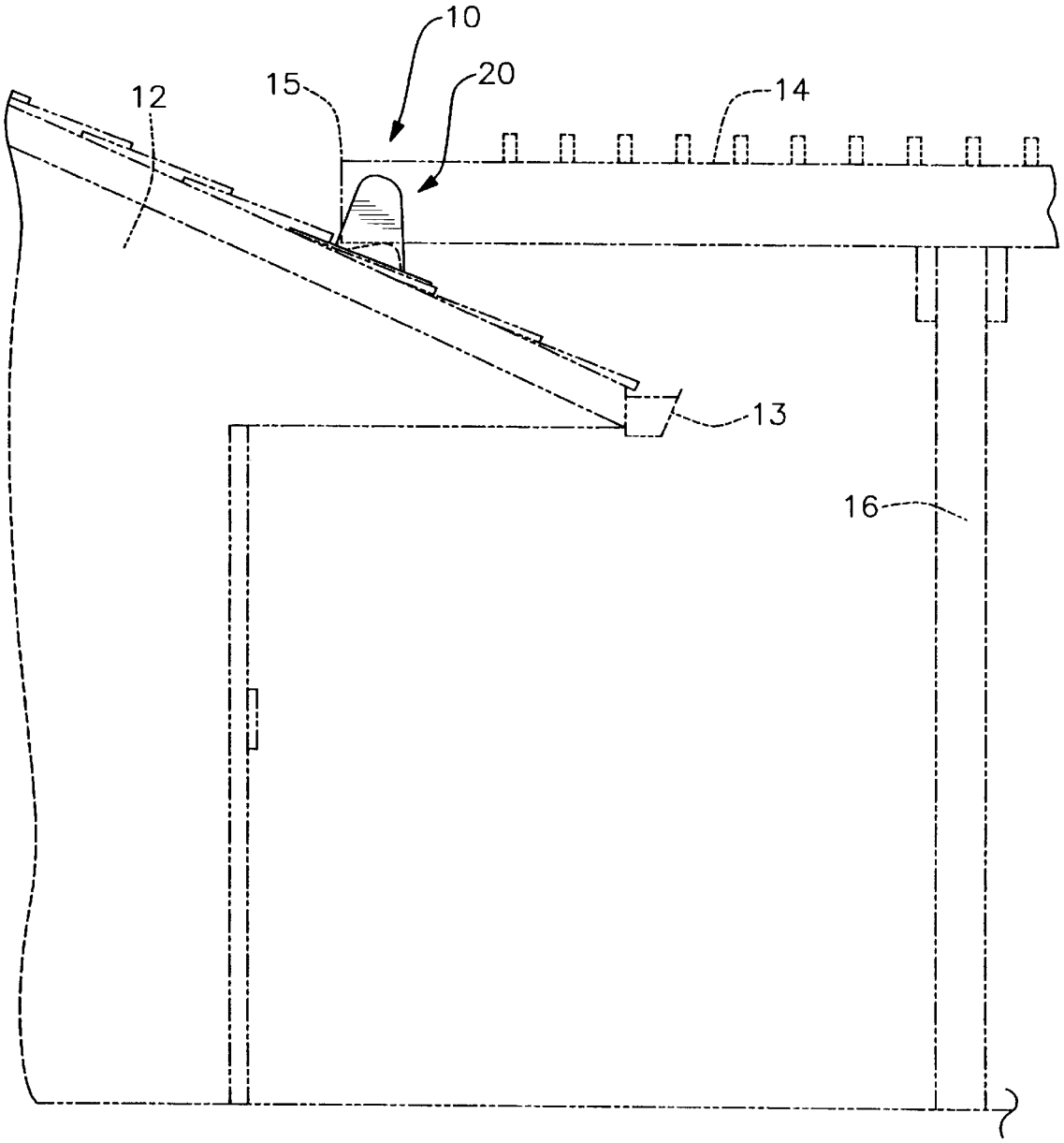
FIG. 3 is a side view of the present invention during use.
Figure 4:
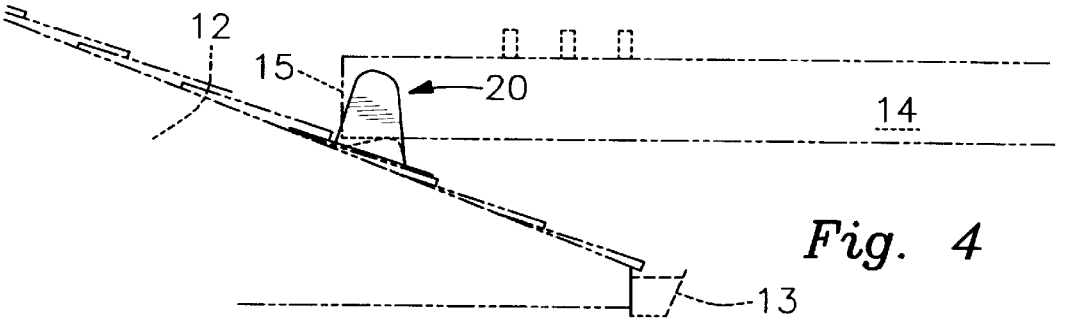
FIGS. 4–7 show the use of the present invention with roofs having various pitches.
Figure 5:
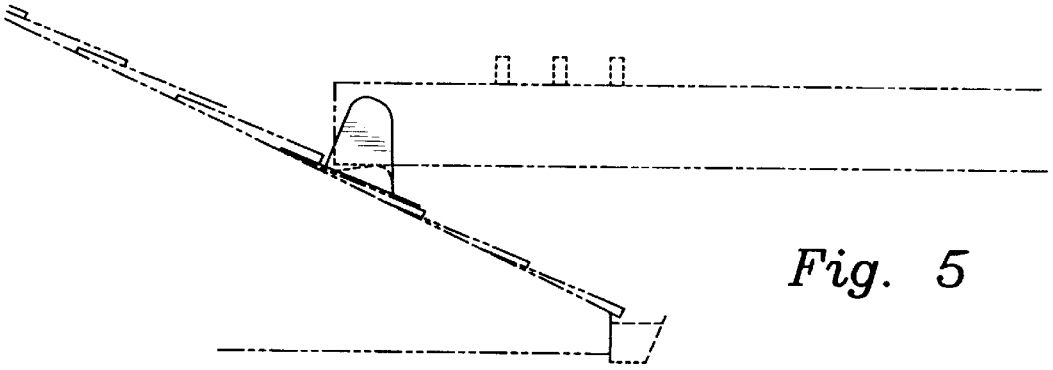
Figure 6:
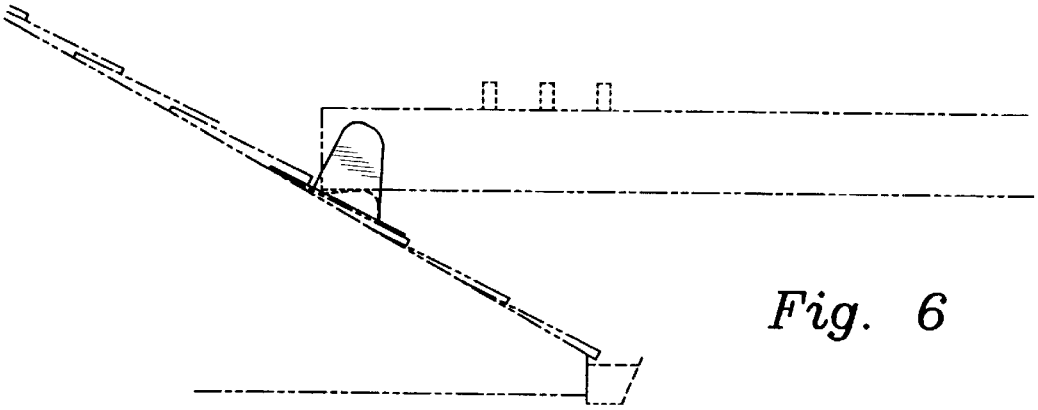
Figure 7:
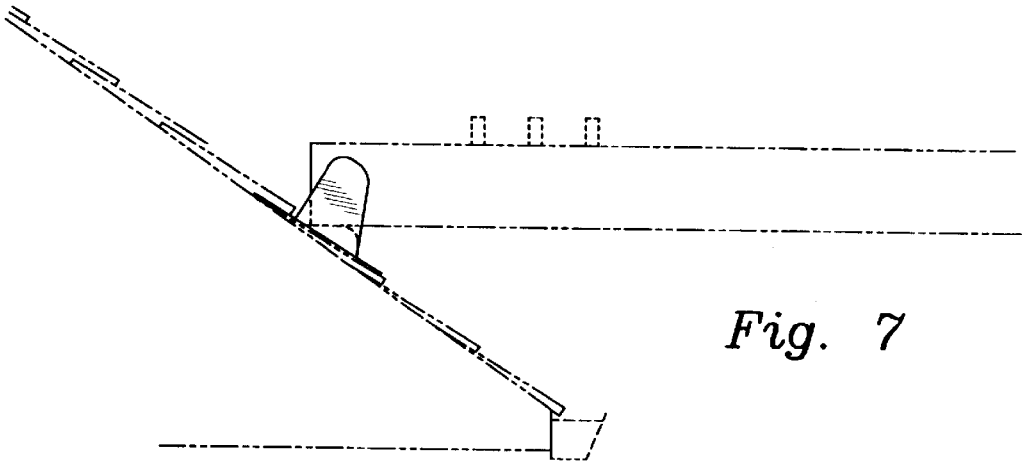

The present invention, as designated as numeral 10, includes a generally planar main roof 12 situated upon a building at a first predetermined angle. A gutter 13 lines a lower periphery of the main roof. Also included is a generally planar auxiliary roof 14 having a plurality of joists 15 extending therefrom in coplanar relationship therewith. A plurality of stanchions 16 is coupled to a bottom of the auxiliary roof and extend downwardly therefrom. As shown in FIG. 3, the stanchions are vertically oriented.

Figure 2:
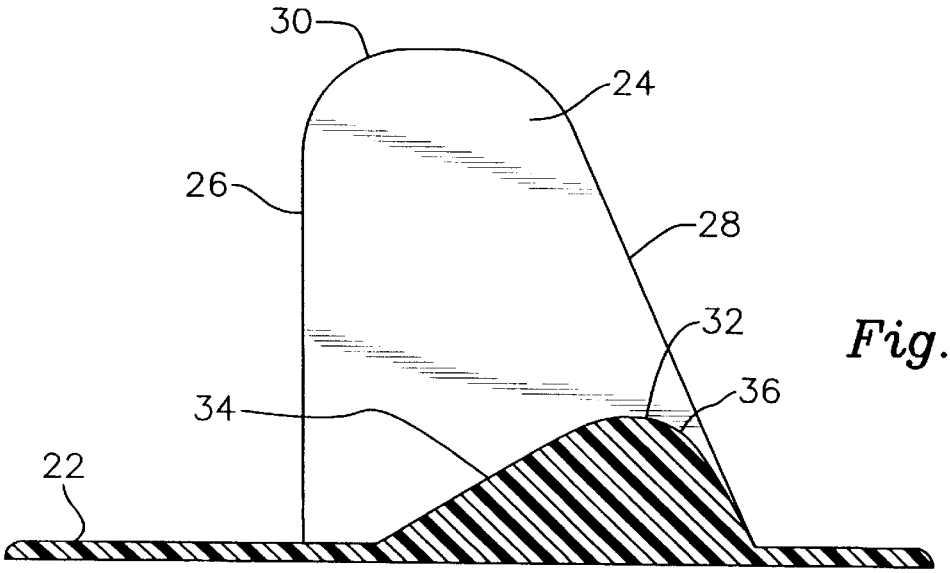
FIG. 2 is a side view of the present invention.

As best shown in FIGS. 1 & 2, a plurality of plastic roofing brackets 20 each comprises a planar generally rectangular base plate 22 positioned on the main roof. Each base plate has a bottom surface, a top surface and a periphery formed therebetween. Ideally, the corners of the base plate are rounded and are further tapered downwardly, as shown in FIGS. 1 & 2. As an option, the base plate may be equipped with a plurality of apertures for facilitating the mounting thereof with the roof.

The top surface of the base plate of each roofing bracket further has a pair of spaced and parallel wings 24 each defined by a planar member integrally coupled to the base plate and residing in a vertical plane. Each planar member of the wings includes a rear vertical edge 26, a front beveled edge 28 and an arcuate top edge 30. Note FIG. 2.

Each roof bracket further includes a solid support module 32 mounted to the base plate and further coupled to the wings therebetween. Each support module includes a rear planar extent 34 residing in a plane which forms an acute angle with the base plate and extends upwardly and forwardly. The support modules each also have a front arcuate extent 36 terminating at the front edge of the parallel wings of the associated roofing bracket. It should be noted that the support module of each roofing bracket has a height less than ⅓ that of the wings. A width of the support module is approximately ½ that of the wings.

During use, the joists rest upon the support modules between the wings of an associated one of the roofing brackets such that the auxiliary roof resides at a second predetermined angle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roof bracket system comprising, in combination:

a generally planar main roof situated upon a building at a first predetermined angle;

a generally planar auxiliary roof having at least one joist extending therefrom in coplanar relationship therewith and at least one stanchion coupled to a bottom of the auxiliary roof and extending downwardly therefrom;

a plurality of roofing brackets, each roofing bracket comprising a planar generally rectangular base plate positioned on the main roof and having a bottom surface, a top surface and a periphery formed therebetween, the top surface of the base plate of each roofing bracket further having a pair of spaced and parallel wings each defined by a planar member being integrally coupled to the base plate and residing in a vertical plane, the planar member including a rear vertical edge, a front beveled edge and an arcuate top edge, each roof bracket further including a support module mounted to the base plate and further coupled to the wings therebetween, the support module including a rear planar extent residing in a plane which forms an acute angle with the base plate and extends upwardly and forwardly and a front arcuate extent terminating at the front edge of the parallel wings of the associated roofing bracket, the support module of each roofing bracket having a height less than ⅓ that of the wings, whereby the joists rest upon the support modules between the wings of an associated one of the roofing brackets such that the auxiliary roof resides at a second predetermined angle.

2. A roof bracket system comprising, in combination:

a generally planar main roof situated upon a building at a first predetermined angle;

an auxiliary roof having at least one joist extending therefrom in coplanar relationship therewith and at least one stanchion coupled to a bottom of the auxiliary roof and extending downwardly therefrom; and a plurality of roofing brackets, each roofing bracket comprising a base plate positioned on the main roof and having a bottom surface, a top surface and a periphery formed therebetween, the top surface of the base plate of the roofing bracket further having a pair of spaced wings each defined by a planar member coupled to the base plate and adapted for receiving a joist therebetween.

3. The roof bracket system as set forth in claim 2 wherein said planar member includes a rear vertical edge, a front beveled edge and an arcuate top edge.

4. The roof bracket system as set forth in claim 2 wherein said roofing bracket further includes a support module mounted to the base plate.

5. The roof bracket system as set forth in claim 4 wherein said support module includes a rear planar extent residing in a plane which forms an acute angle with the base plate and extends upwardly and forwardly and a front arcuate extent terminating at the front edge of the parallel wings of the associated roofing bracket.

6. The roof bracket system as set forth in claim 4 wherein the support module of said roofing bracket has a height less than ⅓ that of the wings.

* * * * *